United States Patent [19]

Temple

[11] 4,015,803

[45] Apr. 5, 1977

[54] KITE WITH AN IMPROVED RUDDER

[76] Inventor: Stephen Temple, 66, Girton Road, Cambridge, England

[22] Filed: Feb. 9, 1976

[21] Appl. No.: 656,602

[52] U.S. Cl. ..... 244/153 R

[51] Int. Cl.[2] ..... B64C 31/06

[58] Field of Search ..... 244/153 R, 154; D34/15 AF

[56] References Cited

UNITED STATES PATENTS 2,388,478 11/1945 Garber ..... 244/153 R X

*Primary Examiner*—Trygve M. Blix
*Assistant Examiner*—Barry L. Kelmachter
*Attorney, Agent, or Firm*—Browdy and Neimark

[57] ABSTRACT

A kite comprising a kite body in the form of a plane sail supported by spars and a rudder formed integrally with the kite body. Two control strings are coupled to the rudder by way of a bridle, the control strings controlling movement of the rudder with respect to the kite body by causing the rudder to be in operation turned into the airflow supporting the kite body thereby to control the attitude of the kite body relatively to the airflow.

8 Claims, 5 Drawing Figures

KITE WITH AN IMPROVED RUDDER

The invention relates to kites and more particularly to kites having controls in the form of plural strings. Plural-string kites have been flown before, and numerous difficulties are associated with their operation. In particular it is difficult to produce an arrangement which is stable under all conditions whilst preserving the ability to turn around a small radius. This leads to great difficulty in learning to fly such a kite. For example, in the common arrangement in which mores than one string is attached to various places on the kite, stall conditions arise when the kite is flown at a large angle to the wind, leading to instability and even reversal of the controls.

According to one aspect of the invention there is provided a kite assembly comprising a kit of parts for assembly into a kite body having a rudder formed on and extending outwardly of the kite body, and a plurality of control strings for coupling to the rudder to control movement of the rudder with respect to the kite body, whereby in operation, the rudder is turned into the airflow supporting the kite body thereby to control the attitude of the kite body relatively to said airflow.

According to another aspect of the invention there is provided a kite comprising a kite body, a rudder, the rudder being formed on and extending outwardly of the kite body, and a plurality of control strings for controlling movement of the rudder with respect to the kite body by causing the rudder to be in operation turned into the airflow supporting the kite body thereby to control the attitude of the kite body relatively to said airflow.

Preferably, the kite comprises a plane sail supported by spars. Advantageously, the rudder is rotatable about an axis at an acute angle to the plane of the kite sail, said axis being disposed in a plane which is normal to the plane of the sail and which contains the axis of a main spar supporting said kite sail.

In one form the rudder is rotatable about an axis lying at an angle to the plane of the kite sail within the range from 30° to 60°.

Numerous advantages can accrue from such an arrangement. The control may be more steadily applied without upsetting the normal balance of the kite, differing degress of control can be provided for learning purposes, the bridle controlling kite movement can be kept fairly simple, and the control may be steadier and smoother than is generally possible with a plurality of control strings attached to the kite body. The rudder steering enables almost the usual manoeuvres to be performed, including square loops, and under some conditions tail slides.

The invention will now be described, by way of example, with reference to the accompanying drawings, in which.

Figure 1:
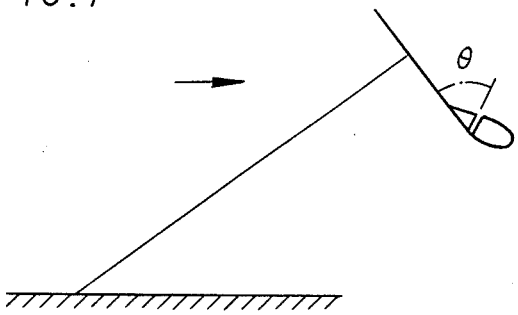
FIG. 1 is a diagrammatic illustration of the attitude in flight of a kite according to the invention.
Figure 2:
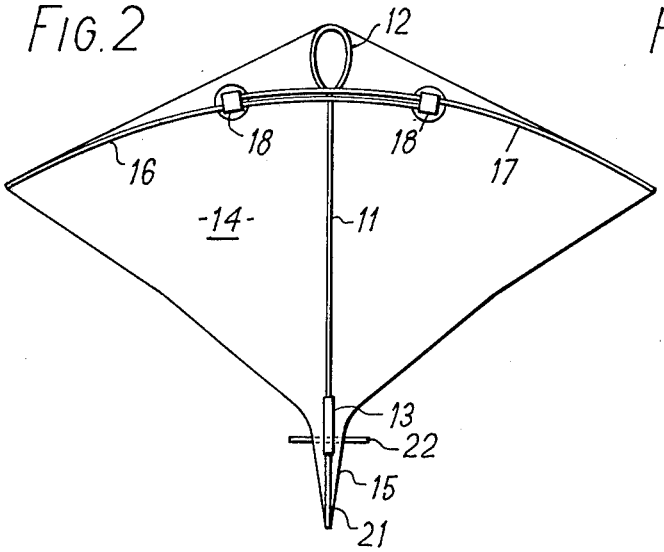
FIG. 2 is a plan view of one embodiment of kite according to the invention, the bridle and control strings being omitted for clarity.
Figure 3:
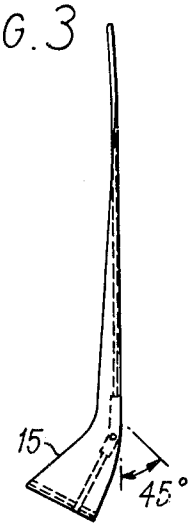
FIG. 3 is a side view of the kite of FIG. 2.
Figure 4:
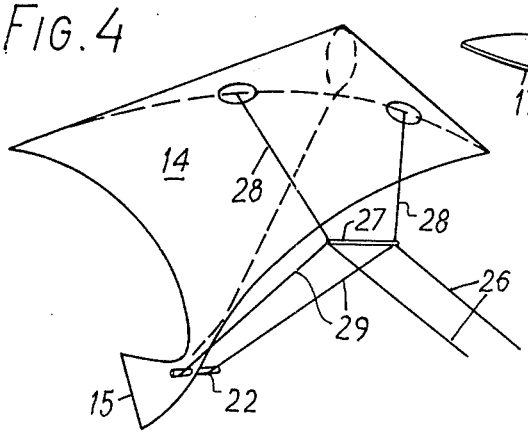
FIG. 4 is a perspective view, in flight of the kite of FIG. 2.

Referring to FIG. 2, this shows the general flying attitude of a kite according to the invention and in particular shows the need to ensure that the axis about which the rudder rotates is at an angle of between 30° and 60° to the plane of the main fore and aft spar of the kite. If the rudder axis is perpendicular to the plane of the said spar, movement of the rudder does not produce a turning force since the rudder cannot be turned into the airflow. It will be understood that a kite differs from an airplane in respect of the air flow around it, and a normal airplane type rudder can be completely ineffective.

Figures 2 to 5 show a kite of the form known as the India fighting kite. It comprises a rigid main spar 11 extending fore and aft of the kite, which carries at its fore end a substantially oval loop 12 and at its aft end a tube 13, both of resilient plastics material such as nylon. The loop 12 lies in the plane of a kite sail 14 and serves to absorb energy on impact of the kite on the ground, whilst the tube 13 is curved from the spar 11 upwardly and serves as the cantilever hinge of a rudder 15. Extending transversely of main spar 11 at its fore end are flexible wing spars 16 and 17 which lie in the plane of sail 14 and are bowed rearwardly from the main spar. The wing spars 16, 17 overlap and are held together by respective sleeves 18 at their overlapping ends and by a resilient grommet 19 adjacent the main spar, there being a clip (not shown) at the grommet by means of which the wing spars are held to the main spar.

The kite rudder includes, extending from the end of cantilever tube 13, a generally T-shaped frame member 21 disposed in a plane containing the main spar and normal to the plane of the sail, the lower arm of the member being somewhat shorter than its upper arm. A steering rod 33 extends through the aft end of cantilever tube 13 transversely of the tube and parallel to the plane of the sail, a force at either end of the rod effecting flexure of tube 13 and hence movement of the rudder. Because of the curvature of tube 13 the axis of turning of the rudder, although disposed in a plane normal to the plane of the sail and containing the axis of the main spar 11, lies at an acute angle to the plane of the sail of about 45°.

The sail 14 of the kite is generally diamond-shaped with pockets at three of its apices by which it is attached to the spars, the pockets at opposed apices receiving the tips of the wing spars 16, 17 and the pocket at the third apex receiving the fore end of the oval loop 12 on the main spar 11. The fourth apex of sail 14 is formed at the rudder. The sail extends back below the cantilever tube 13 and lower arm of frame member 21 and is folded upwardly, there being a further fold extending along the arms of the frame member such that the rudder surfaces are formed by a fourth pocket of the sail and lie substantially normal to the plane of the sail. Openings are provided in the said through which the ends of steering rod 22 project. It will be understood that the rudder is open along its upper edge and that the sail edges may if desired be joined together at this location, for example by heat sealing or stapling.

The kite is controlled by a bridle 25 from which two control strings 26 extend to the ground, a difference in tension between the control strings effecting turning of the rudder. The bridle 25 comprises a rigid strut 27 to respective ends of which the control strings 26 are connected. The ends of strut 27 are connected by strings 28 to respective sleeves 18 of the wing spars, and by further strings 29 to respective ends of the steering rod 22. Thus, an unequal tension in the control strings produces a distortion of the bridle and hence rudder movement. Because the strings 28 are connected to sleeves 28, which have a spacing greater than the length of strut 27, the strut 27 is always in tension and may if desired be replaced by a further string.

Figure 5:
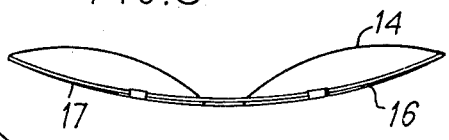
FIG. 5 is a front view of the kite of FIG. 2, showing the profile, in flight, of the wing spars and the sail.

In flight of the kite the wing spars 16, 17 flex, as shown in FIG. 5, allowing the sail to take up a stable shape. The kie accordingly has a high rate of climb and high lift to drag ratio, thus permitting a large flying area at extreme angles to the wind direction. The overlap of the wing spars enables them to be made of a lightweight material such as bamboo, which can flex whilst providing adequate strength at the centre. By pulling on one control string 26 more than the other the kite is tilted slightly and the rudder is turned, causing the kite to circle.

In the rudder arrangement shown the cantilever tube 13 serves as a spring to keep the rudder in the neutral position. This greatly improves the stability of the kite and also provides for varying degrees of control sensitivity by alteration of the effective spring rate: a stiff tube permits little rudder movement and maintains stability, thus allowing beginners to learn the control, whilst a pliable tube gives great sensitivity of control and allows spectacular manoeuvres.

It will be understood that the kite described is collapsible. By sliding the sleeve 18 outwardly and unclipping the wing spars from the main spar the kite can be dismantled and folded like an umbrella. Furthermore, the kite may be provided as an assembly kit.

I claim:

1. A kite comprising a plane sail; a plurality of spars including a main spar having an axis and supporting said sail; a rudder, said rudder being formed on and extending outwardly of said sail and being rotatable about an axis of rotation at an acute angle to the plane of said sail, said axis of rotation being disposed in a plane which is normal to said plane of said sail and which contains said axis of said main spar supporting said sail; and a plurality of control strings for controlling movement of said rudder with respect to said sail by causing said rudder to be in operation turned into the air flow supporting said said therely to control the attitude of said sail relatively to said air flow.

2. A kite as claims in claim 1, wherein said axis of rotation lies at an angle to said plane of said sail within a range from substantially 30° to substantially 60°.

3. A kite as claimed in claim 2, wherein said rudder is formed integrally with said sail.

4. A kite as claimed in claim 3, wherein the kite is collapsible.

5. A kite as claimed in claim 4, wherein said spars are supporting spars which are detachably coupled together and which overlap over portions of the lengths thereof so as to strengthen said sail at the region of overlapping.

6. A kite as claimed in claim 1, wherein said control strings comprise two control strings coupled to said rudder by way of a bridle, said bridle serving to effect rotation of said rudder in opposite senses in response to a difference in tension between said two control strings.

7. A kite assembly in the form of a kit of parts for assembly into a kite, the kit comprising a plane sail; a plurality of spars including a main spar having an axis for supporting said sail; a rudder formed on and extending outwardly of said sail and being rotatable about an axis of rotation at an acute angle to the plane of said sail, said axis of rotation being disposed in a plane which in normal to said plane of said sail and which is to contain said axis of said main spar; and a plurality of control strings to be coupled to said rudder to control movement of said rudder with respect to said sail and which, in operation, turn said rudder into the airflow supporting said sail thereby to control the attitude of said sail relatively to said airflow.

8. A kite assembly as claimed in claim 7, wherein said control strings comprise two control strings and wherein the assembly further includes a bridle by way of which said two control strings are to be coupled to said rudder, said bridle serving in operation to effect rotation of said rudder in opposite senses in response to a difference in tension between said two control strings.

* * * * *